United States Patent [19]

Azuhata et al.

[11] Patent Number: 4,741,279

[45] Date of Patent: May 3, 1988

[54] METHOD OF AND APPARATUS FOR COMBUSTING COAL-WATER MIXTURE

[75] Inventors: Shigeru Azuhata, Hitachi; Kazutoshi Higashiyama, Katsuta; Kiyoshi Narato, Ibaraki; Hironobu Kobayashi, Katsuta; Norio Arashi, Hitachi; Tooru Inada; Kenichi Sohma, both of Hitachi; Keizou Ohtsuka, Katsuta; Yoshitaka Takahashi, Kure; Fumio Koda, Kure; Tadahisa Masai, Kure; Masakiyo Tanikawa, Kure; Kei Kawano, Kure, all of Japan

[73] Assignees: Hitachi, Ltd.; Babcock-Hitachi Kabushiki Kaisha, both of Tokyo, Japan

[21] Appl. No.: 1,166

[22] Filed: Jan. 7, 1987

[30] Foreign Application Priority Data

Jan. 8, 1986 [JP] Japan ..... 61-629
Oct. 25, 1986 [JP] Japan ..... 61-254086

[51] Int. Cl.[4] ..... F23D 1/00

[52] U.S. Cl. ..... 110/347; 110/264; 431/9; 431/182

[58] Field of Search ..... 110/264, 347, 263; 431/182, 183, 184, 9

[56] References Cited

U.S. PATENT DOCUMENTS 3,124,086 3/1964 Sage et al. ..... 110/264
3,817,685 6/1974 Joannes ..... 431/116
4,545,307 10/1985 Morita et al. ..... 110/264
4,569,295 2/1986 Skoog ..... 110/264 X
4,644,878 2/1987 Nodd et al. ..... 110/264
4,685,882 8/1987 Binasik et al. ..... 431/182

*Primary Examiner*—Edward G. Favors
*Attorney, Agent, or Firm*—Fay, Sharpe, Beall, Fagan, Minnich & McKee

[57] ABSTRACT

A method of combusting a coal-water mixture fuel. The mixture is atomized into a conically-shaped primary pre-combustion chamber. Primary air is supplied, at a rate smaller than that required for complete burning of the mixture and in the form of a swirl about the axis of the jet of the atomized mixture, from the peripheral portion of the primary pre-combustion chamber into a secondary pre-combustion chamber connected to said primary pre-combustion chamber, thus forming a region of low pressure around the jet of the mixture. The region of low pressure serves to induce the atmosphere gas from the secondary pre-combustion chamber of higher temperature back into the primary pre-combustion chamber of a lower temperature, so that the water content of the mixture is evaporated and the mixture is ignited by the heat of the hot atmosphere gas. Then, the mixture is burnt in the secondary pre-combustion chamber in the presence of the remainder portion of the primary air, at a comparatively small air-to-ratio, so that a region of a reducing atmosphere is formed to suppress the generation of NOx. Then, secondary air is supplied, in the form of a swirl about the axis of the jet of the mixture and at a rate sufficient to completely burn the mixture, into the furnace connected to the secondary pre-combustion chamber, thus completely combusting the coal-water mixture.

13 Claims, 5 Drawing Sheets

METHOD OF AND APPARATUS FOR COMBUSTING COAL-WATER MIXTURE

BACKGROUND OF THE INVENTION

The present invention relates to a method of and apparatus for combusting a special fuel such as a flame-resistent solid fuel, a liquid fuel or a fuel in a slurry-like state. More particularly, the invention is concerned with a method of and apparatus for combusting a coal-water mixture fuel at a high combustion rate and with a reduced NOx production.

One of the problems encountered in the utilization of coal resides in that the solid coal is generally more difficult to transport, store and handle than gas or liquid fuel. In view of this fact, various studies and attempts have been made to enable coal to be handled as a fluid fuel. Among these attempts, a method which makes use of coal-water mixture (referred to as CWM hereinafter), which is a mixture of pulverized coal and water, is considered as being most promising and is attracting the world's attention because of low costs of production and transport and because of easiness of handling, i.e., a superior overall economy.

In order to combust CWM successfully, it is essential that the CWM is injected into a furnace in the form of fine droplets. In general, so-called twin-fluid atomizer, adapted to make an atomizing medium of high velocity with the medium to be atomized, is suitably used for the purpose of atomizing comparatively viscous fluid such as CWM. The higher the velocity of the atomizing medium, the higher the atomizing performance, and, the finer the droplets, the higher the ignitability. Therefore, when this type of atomizer is applied to CWM, the velocity of the CWM droplets atomized from the atomizer is about 5 times as high as the velocity of pneumatic transportation of pulverized coal. Furthermore, the combustion of the atomized CWM essentially requires evaporation of water content in advance of the ignition. Partly because of the high velocity of atomized fuel, and partly because of the necessity for evaporation of water content, the ignition point tends to appear at a downstream portion of the atomized fuel. The shifting of the ignition point towards the downstream side adversely affects the stability of the flame, as well as the combustion efficiency.

It is to be understood that the combustion of CWM also requires the NOx production to be suppressed, as in the cases of other types of fuel. Practically, it is desired that the rate of NOx production during combustion of CWM is as small as that in the combustion of pulverized coal, at the greatest. This in turn requires a stable reducing region to be formed in the flame. Coal produces reducing agents such as hydrogen, carbon monoxide and so forth, in combustion under insufficient supply of combustion air, i.e., under so-called low air-to-ratio combustion condition. Therefore, in order to effect the combustion with reduced NOx production, it is necessary that the combustion region under low air-to-ratio is maintained stably.

To cope with such a demand, it has been proposed to use a low NOx burner for pulverized coal, in which the combustion air is first significantly separated from the coal and then progressively mixed with the coal so as to stably form a reducing region.

In case of the CWM, however, the ignition is delayed by the time required for the evaporation of water, and the CWM is injected at a high velocity when atomized, so that the flame tends to be formed at a position remote from the burner exit, as explained before.

In other words, the combustion takes place in the downstream region in which the mixing of CWM with the combustion air proceeds rapidly. It is, therefore, not easy to form the reducing region stably, unlike the case of the combustion of pulverized coal. This means that the reduction in the NOx production is rather difficult to attain in the case of CWM. In addition, the low ignitability of CWM directly causes a reduction in the combustion efficiency. Furthermore, the formation of the flame at a position remote from the burner causes the combustion to become unstable, with the risk of misfire, resulting in an inferior reliability of the combustion system.

Since the combustion characteristic is adversely affected by the formation of flame at a position remote from the burner, it is a key to the development of excellent CWM burner to design such that the flame is positioned as close as possible to the burner.

It has been already known that to form the flame in the region adjacent to the burner exit is possible by introducing the combustion air in the form of swirling flow. For instance, Japanese patent Laid-Open No. 208305/1984 discloses a burner for pulverized coal in which tertiary combustion air is introduced as a strong swirling flow from a tertiary air nozzle which is located remotely from the fuel nozzle. The strong swirl of the combustion air may be effective in the case of combustion of pulverized coal, because in such combustion the pulverized coal is jetted by the similar velocity of the combustion air. However, in the case of the combustion of CWM in which the fuel is atomized from the fuel nozzle at a velocity which is 3 to 5 times as high as the velocity of combustion air, it is very difficult to stably hold the flame solely by the momentum of swirl flow. Namely, in order to stably hold the flame by the swirl flow solely, the level of swirl flow has to be controlled to fall within an extremely narrow range, which could be attained only through a highly complicated and difficult control of the burner.

Japanese patent Laid-Open No. 145405/1984 discloses a burner device designed for burning oil fuels and intended particularly for shortening the flame. This burner can produce an appreciable effect on the fuels which have high levels of ignitability such as oil fuels, but cannot produce any remarkable effect on fuels having low levels of ignitability such as CWM. To explain in more detail, this burner has a primary air nozzle surrounding the fuel nozzle, and a primary burner metal is disposed such as to surround the primary air nozzles. When combustion of the fuel takes place within the primary burner metal, the vacuum region generated by the high-velocity flow of fuel is extinguished by the primary air, so that the induction of secondary air into the combustion region defined by the primary burner metal is extinguished to impair the ignitability. Namely, the ignition and holding of flame require a stable circulating flow to be formed around the stream of fuel, and the introduction of the primary air goes quite contrary to this demand. For these reasons, the burner device shown in Japanese patent Laid-Open No. 145405/1984 cannot be used suitably for the combustion of CWM.

As explained above, for attaining a good combustion with CWM, it is an important technical subject to achieve a significant improvement in the ignitability of CWM.

SUMMARY OF THE INVENTION

Accordingly, an object of the present invention is to improve ignitability of a fuel, particularly a coal-water mixture, so as to realize a stable flame and to improve the combustion efficiency, while reducing production of NOx.

To this end, according to one aspect of the present invention, there is provided a method of combusting a coal-water mixture comprising: atomizing the mixture into a conical primary pre-combustion chamber; supplying, in the form of a swirl about the axis of the jet of the atomized mixture, primary air from outer peripheral portion of the primary pre-combustion chamber into a secondary pre-combustion chamber connected to the primary pre-combustion chamber, at a rate smaller than that required for the complete burning of the mixture, so as to form a region of low pressure around the jet of said mixture, the region of low pressure serving to induce atmosphere gas from the secondary pre-combustion chamber of a higher temperature than the primary pre-combustion chamber back into the primary pre-combustion chamber thereby to promote the evaporation of water content of the mixture and to ignite said mixture; causing the mixture to be mixed with the remainder portion of the primary air in the secondary pre-combustion chamber so as to combust the mixture at a low air-to-ratio, so as to form a region of a reducing atmosphere thereby suppressing generation of NOx; and supplying, in the form of a swirl about the axis of the jet of the mixture and at a rate large enough to completely burn the mixture, secondary air into a furnace connected to the secondary pre-combustion chamber, thereby completely combusting the mixture.

According to one form of another aspect of the present invention, there is provided an apparatus for combusting a coal-water mixture comprising: a fuel nozzle for atomizing said mixture into fine particles and jetting the same into a furnace; a primary pre-combustion chamber coaxial with the fuel nozzle and conically diverging from the end of the fuel nozzle; a secondary pre-combustion chamber provided downstream from said primary pre-combustion chamber; an annular primary air nozzle arranged around the outer periphery of said primary pre-combustion chamber and adapted to supply primary air into the secondary pre-combustion chamber in the form of swirl about the axis of the nozzle; and a secondary air nozzle disposed around the outer periphery of the secondary pre-combustion chamber and adapted for supplying secondary air into the furnace in the form of a swirl about the axis of said nozzle.

According to another form of another aspect of the present invention, there is provided an apparatus for combusting a coal-water mixture comprising: a fuel nozzle for atomizing the mixture into fine particles and jetting the same into a furnace; a primary pre-combustion chamber disposed coaxially with said fuel nozzle, the primary pre-combustion chamber being defined by a flame holder having a plurality of gaps through which seal air is supplied in the form of a swirl about the axis of the fuel nozzle 1 so that the seal air flows along the inner peripheral wall of the primary pre-combustion chamber; a secondary pre-combustion chamber disposed downstream from the primary pre-combustion chamber; an annular primary air nozzle disposed on the outer periphery of the primary pre-combustion chamber and adapted to supply primary air into the secondary pre-combustion chamber in the form of a swirl about the axis of the fuel nozzle; and a secondary air nozzle disposed on the outer periphery of the secondary pre-combustion chamber and adapted to supply secondary air into the furnace in the form of a swirl about the axis of the fuel nozzle.

DESCRIPTION OF THE PREFERRED EMBODIMENTS

Figure 1:
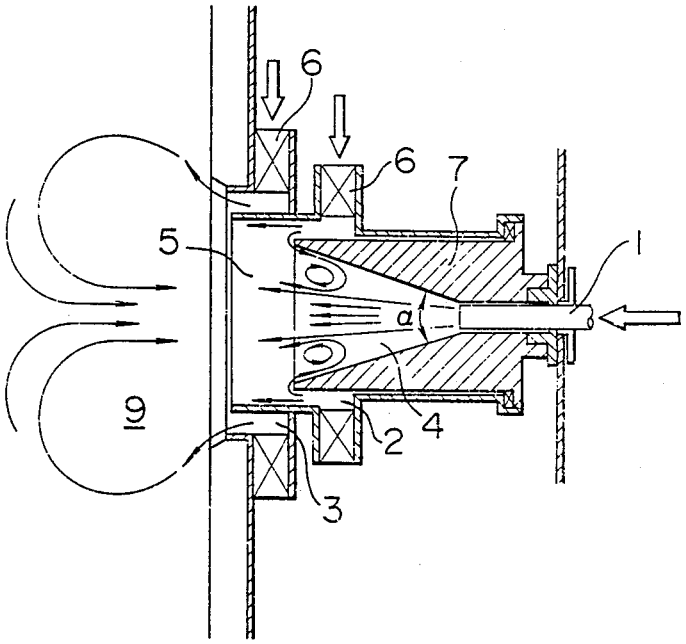
FIG. 1 is a longitudinal sectional view of an embodiment of a combustion apparatus in accordance with the present invention.

A preferred embodiment of the present invention will be described hereinafter with reference to FIGS. 1 and 2. A combustion apparatus embodying the present invention has a fuel nozzle 1 adapted for atomizing a slurry-like fuel consisting of CWM, a primary pre-combustion chamber 4 which is disposed coaxially with the fuel nozzle 1 and which conically diverges from the end of the fuel nozzle, and an annular primary air nozzle 2 disposed around the primary pre-combustion chamber and adapted for supplying combustion air in the form of a swirl around the axis of the nozzle. The primary air nozzle 2 has an inner cylinder which defines the outer peripheral surface of the primary pre-combustion chamber 4. A reference numeral 5 denotes a secondary pre-combustion chamber formed by an outer cylinder of the primary air nozzle 2 ahead of the primary pre-combustion chamber. An annular secondary air nozzle 3 is disposed around the outer peripheral surface of the secondary pre-combustion chamber 5 and is adapted to supply combustion air in the form of a swirl. The outer cylinder of the primary air nozzle 2 serves also as an inner cylinder of the secondary air nozzle 3. A reference numeral 6 designates a swirl generator provided on the outlet of each of the primary and secondary air nozzles 2 and 3, so as to form the swirl of the combustion air from each air nozzle. Numerals 7 and 9 denote, respectively, a block portion of the primary pre-combustion chamber and the furnace as a whole.

In operation, a CWM as the fuel is atomized and jetted by the fuel nozzle 1 into particles having a mean particle size ranging generally between 40 and 100 μm and the thus atomized CWM is ignited within the conical primary pre-combustion chamber 4 around the fuel nozzle. The CWM is then burnt under the supply of the primary air, within the cylindrical secondary pre-combustion chamber 5 downstream of the primary pre-combustion chamber 4, and is completely burnt within the furnace under the supply of the secondary air. Any increase in the jetting velocity of CWM has a tendency to promote the atomization of the CWM into finer particles, so that this velocity is usually selected to be 3 to 5 or more times higher than the velocity of the combustion air. In addition, the primary air is supplied in the form of a swirl around the axis of the fuel nozzle 1. Therefore, a negative static pressure is created in the region around the jet of CWM. This in turn produces a force which acts to induce into the primary pre-combustion chamber 4 a part of the primary air, i.e., a part of the atmosphere gas in the secondary pre-combustion chamber of a higher temperature than the primary pre-combustion chamber. The thus induced hot gas serves to promote both the evaporation of the water content of the CWM and the ignition of the latter. The remainder part of the primary air which was not used in the ignition is mixed with the CWM within the secondary pre-combustion chamber 5, before the CWM is mixed with the secondary air, so that combustion is maintained with small air-to ratio. As a result of such combustion, a region of reducing atmosphere is formed so as to suppress the generation of NOx. The CWM is then burnt completely as it is mixed with the secondary air supplied through the secondary air nozzle 3.

The air outlet of the primary air nozzle 2 is disposed within the outlet of the secondary air nozzle 3, so as to form therebetween the secondary pre-combustion chamber 5. The control of the ratio between the amount of primary air induced into the primary pre-combustion chamber 4 and the amount of the same consumed in the secondary pre-combustion chamber is conducted through a control of the strength or magnitude of the swirl of the primary air, so that a stable flame is formed and maintained by suitably selecting the strength of the swirl. Thus, the primary air is intended for the ignition of the CWM and the formation of the flame of combustion with low air-to-ratio. Thus, the rate of supply of the primary air is selected to be smaller than that necessary for the complete combustion of CWM.

The block 7 constituting the primary pre-combustion chamber 4 may be made of a steel. From the view point of heat accumulation, as well as durability against burning down, it is preferred to use a heat-resistant ceramics material or refractory bricks. It is a common measure that the combustion apparatus for CWM is preheated by burning a gaseous fuel or a liquid fuel, until the furnace temperature is raised to a level high enough to form a flame of CWM. When a brick material having a large heat accumulation capacity is used, heat is accumulated during the preheating so that the ignition of CWM is facilitated by the heat from the block. It is also possible to use a heat-generating member such as a ceramics heater as the constituent of the block 7. In such a case, it is possible to heat the jet of the CWM by the heat generated by the heat-generating member and to control the ignition by adjusting the heat output from the heat-generating member.

It is thus possible to improve the ignitability of the CWM when the same is first supplied to the burner, by selecting the material of the block 7 from the view point of heat accumulation or heat-generating properties. Once a stable flame is formed, the significance of the ignitability becomes not so serious, because the block 7 is heated by the heat from the flame.

Figure 2:
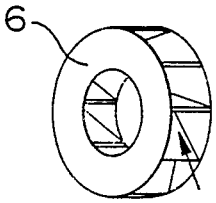
FIG. 2 is a perspective view of a swirl flow generator incorporated in the apparatus shown in FIG. 1.

In addition to the supply of heat for ignition, the primary pre-combustion chamber 4 as shown in FIG. 1 is effective in approaching the flame to the burner because the velocity of the CWM jetted at high velocity is reduced in the primary pre-combustion chamber 4 and the CWM is allowed to stay for a long time in the primary pre-combustion chamber 4 before it is mixed with the secondary air within the secondary combustion chamber 5. That is, the formation of the flame in the secondary pre-combustion chamber is facilitated.

In order to maximize the reduction of the velocity of the CWM jet, it is preferred to design the primary pre-combustion chamber as large as possible in size. A too large size of the primary pre-combustion chamber 4, however, causes other problems such as deflection of the jet of the CWM and deposition of the CWM particles to the inner surface of the wall. For this reason, it is necessary to design the primary pre-combustion chamber to have a size falling within a certain suitable range. In addition, the angle $\alpha$ of divergence of the primary pre-combustion chamber 4 to be greater than the atomizing angle of the CWM fuel nozzle 1.

The secondary pre-combustion chamber 5 is defined by the inner cylinder of the annular secondary air nozzle 3 and is disposed downstream from the primary pre-combustion chamber 4. As explained before, the secondary pre-combustion chamber 5 is utilized for allowing the CWM to be burnt under the supply of the primary air. It has been explained also that combustion with reduced NOx production essentially requires the formation of a reducing region through combustion with small air-to-ratio. The provision of the secondary pre-combustion chamber facilitates such combustion with small air-to-ratio, and provides a distinctive border between the function of the primary air and that of the secondary air. Since the air outlet of the secondary air is disposed downstream from the secondary pre-combustion chamber 5, the mixing of the CWM with the secondary air is adequately delayed.

In addition, since the flow of the primary air is prevented from spreading outward by the presence of the inner wall of the secondary pre-combustion chamber 5, i.e., the inner cylinder of the secondary air nozzle 3, the mixing with CWM is promoted to facilitate the flame of combustion with low air-to-ratio.

Usually, the nozzles for the primary air and the secondary air are made of steel. However, it is effective to use a heat-resistant ceramics material having a large heat-accumulating capacity or a ceramic heater as the material of these nozzles, in order to promote the combustion with low air-to ratio, as in the case of the block 7.

As has been described, in the burner of the present invention shown in FIG. 1, it is possible to improve the ignitability of CWM and to facilitate the formation of stable flame, thus contributing to an improvement in the combustion efficiency. In addition, the formation of the flame of combustion with low air-to-ratio is facilitated, and the size of the reducing region can be increased by an amount proportional to the amount of delay of the mixing with the secondary air. Thus, the burner shown in FIG. 1 is effective in suppressing the generation of NOx.

The delay of the timing at which the CWM is mixed with the secondary air causes the flame to be elongated, which in turn requires the apparatus as a whole to have an increased size. This problem is effectively overcome by the swirling flow of the secondary air. Namely, the swirling of the secondary air flow generates a region of negative pressure within the swirl, which in turn creates a flow of gas from the downstream side towards the upstream side, at downstream side of the flame. This in turn promotes the mixing of the CWM with the secondary air, thus preventing the flame from becoming long.

Figure 3:
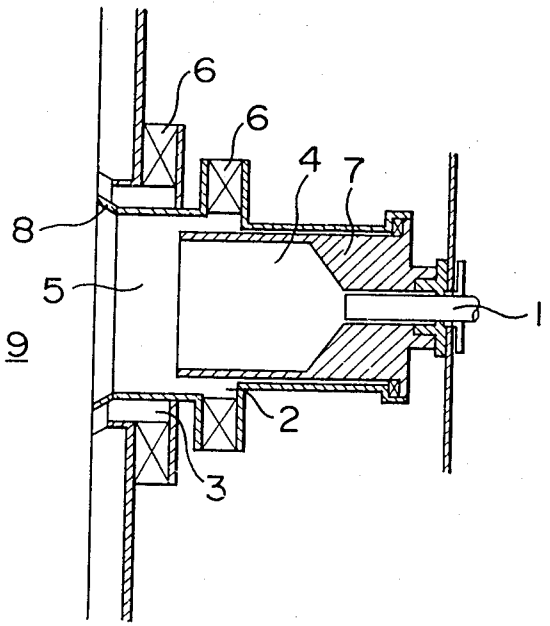
FIG. 3 is a longitudinal sectional view of a modification of the combustion apparatus shown in FIG. 1.

FIG. 3 shows another embodiment which is different from the preceding first embodiment in the following point. Namely, in this embodiment, the angle of divergence of the primary pre-combustion chamber 4 around the fuel nozzle 1 is increased as compared with that of the first embodiment. In addition, the primary pre-combustion chamber 4 has a prolonged cylindrical portion downstream of the conically diverging portion. With this arrangement, it is possible to obtain a large volume of the primary pre-combustion chamber 4, so that the effect produced by the primary pre-combustion chamber 4 is enhanced. This arrangement, however, requires a high degree of axial alignment between the axis of the combustion chamber and the axis of the fuel nozzle 1, for otherwise the induction of the primary air is deflected with the result that the jet of the CWM is offset from the axis of the fuel nozzle. Thus, a high degree of concentration and care is required in the fabrication of the burner part and the assembly of the same.

In addition to the feature concerning the form of the primary pre-combustion chamber 4, the embodiment shown in FIG. 3 features a deflector plate diposed at the air outlet of the secondary air nozzle, so that the timing of mixing of the CWM and the secondary air is further delayed as compared with the first embodiment. Needless to say, such a deflector plate 8 may be provided also on the burner of the first embodiment shown in FIG. 1, and the provision of such a deflector plate will contribute to a further reduction in the rate of generation of NOx. Whether the deflector plate 8 is to be used depends on the capacity of the burner, i.e., the rate of combustion performed by the burner. If the capacity of the burner is large, the diameter of the burner also is large so that the timing of mixing with the secondary air can be delayed without using any specific means such as the deflector 8. Conversely, when the capacity of the burner is small, the diameter of the burner also is small correspondingly, so that the mixing of the primary and secondary air is promoted. In such a case, therefore, it is necessary to employ a suitable measure for the purpose of distinction between the function of the primary air and the function of the secondary air.

The configuration of the block 7 constituting the primary pre-combustion chamber, also may be modified according to the capacity of the burner. For instance, it is possible to attach a deflector plate similar to that on the secondary air nozzle shown in FIG. 3, while enhancing the strength of the swirl of the primary air or velocity of the same, so that a region of negative pressure is formed inside the deflector plate, thereby enhancing the rate of induction of the primary air into the primary pre-combustion chamber 4. It is also possible to install various shapes of flame holding plate on the inner periphery of the outlet of the primary pre-combustion chamber 4, so as to form a drastic contracting flow on the inner periphery of the outlet of the primary pre-combustion chamber 4.

When the coal component of the CWM has a low combustibility, it is possible to omit the secondary air nozzle. In such a case, whole of the combustion air is supplied as the primary air. The provision of the secondary pre-combustion chamber, however, is effective also in this case. Thus, in such an arrangement, the seconary pre-combustion chamber is formed by the outer wall of the whole burner apparatus.

Figure 4:
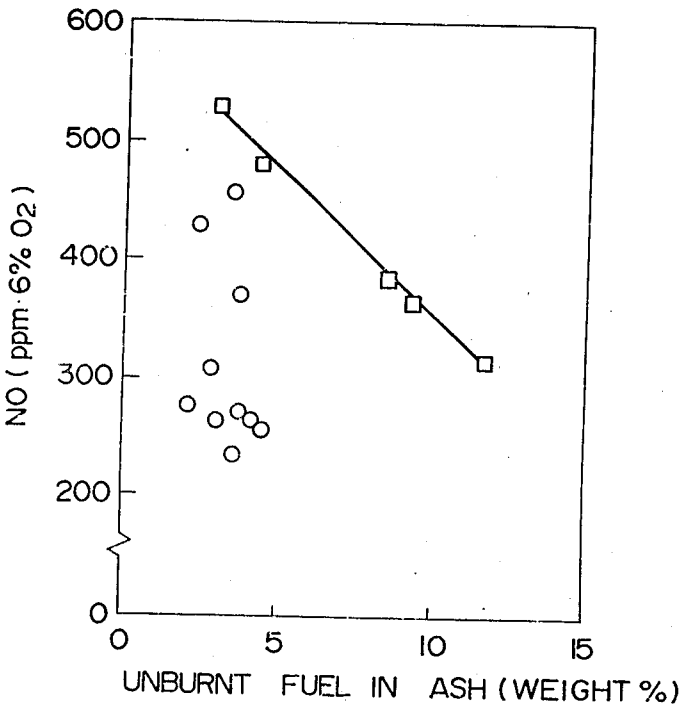
FIG. 4 is a diagram showing the combustion characteristic of the combustion apparatus shown in FIG. 1.

FIG. 4 shows the result of a test combustion of a CWM fuel conducted with the burner shown in FIG. 1. For a comparison purpose, this Figure shows also the result of a test combustion of the same CWM fuel conducted with a low-NOx burner for pulverized coal of the type shown in Japanese patent Laid-Open No. 208305/1984, the burner employed a CWM nozzle in place of the pulverized coal nozzle. The CWM nozzle used in this known burner was the same as that used in the burner shown in FIG. 1. In this Figure, axis of abscissa represents the ratio of the amount of unburnt substance to the amount of the ash collected at the outlet of the furnace. Thus, the smaller the value on the axis of abscissa, the higher the combustion efficiency.

Axis of ordinate represents the concentration of NOx as measured at the outlet of the furnace, converted to a value corresponding to a standard $O_2$ concentration of 6%. In general, when the content of the unburnt substance in the ash is large, the generation of NOx is small. It is, therefore, preferred that the burner can reduce both the content of unburnt substance and the generation of NOx, and such combustion characteristic is highly desirable.

The CWM fuel used in the test contained 63 wt. % of pacific ocean coal and 37 wt. % of water. The mark □ in the figure shows the values obtained with the low-NOx burner for pulverized coal. In general, pulverized coal exhibits a higher ignitability than CWM, so that a high combustibility is ensured and the NOx production is suppressed by the burner shown in Japanese patent Laid-Open No. 208305/1984, even when the mixing of the combustion air and the fuel can be conducted for a comparatively long time. In contrast, as will be seen from FIG. 4, it is difficult to simultaneously attain both a high effect of suppression of NOx and high combustion efficiency, when the CWM fuel is burnt with the burner for pulverized coal.

The values obtained with the burner shown in FIG. 1 are plotted by a mark O. From FIG. 4, it will be seen that the burner shown in FIG. 1 can effectively burn the CWM in the region where the content of unburnt substance is small, as compared with the known burner for pulverized coal. It is clear also that the burner shown in FIG. 1 enables the emission of NOx to be descresed, without being accompanied by any reduction in the combustion efficiency. The amount of emission of NOx is controllable through controls of factors such as the ratio of flow rate between the primary air and the secondary air, and the strengths of swirl of the primary air and the secondary air. Thus, the burner in accordance with the present invention is effective in the combustion of CWM fuels, as will be understood from the foregoing explanation in conjunction with FIG. 4.

Still another embodiment of the invention will be explained hereinafter with reference to FIGS. 5 to 11.

The combustion apparatus shown in FIGS. 5 to 8 features the provision of means for preventing deposition of CWM on the inner wall surface of the primary pre-combustion chamber of the combustion apparatus shown in FIG. 1. Other portions are materially the same as those of the embodiment shown in FIG. 1, so that detailed description of such portions is omitted.

Figure 5:
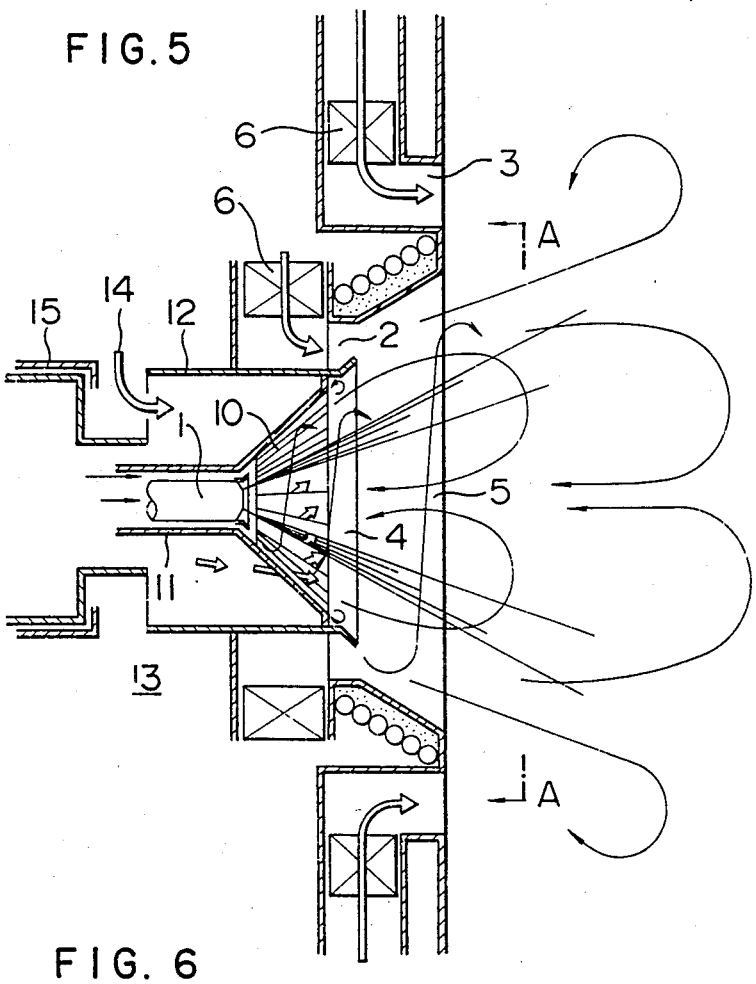
FIG. 5 is a longitudinal sectional view of another embodiment of the combustion apparatus in accordance with the present invention.
Figure 6:
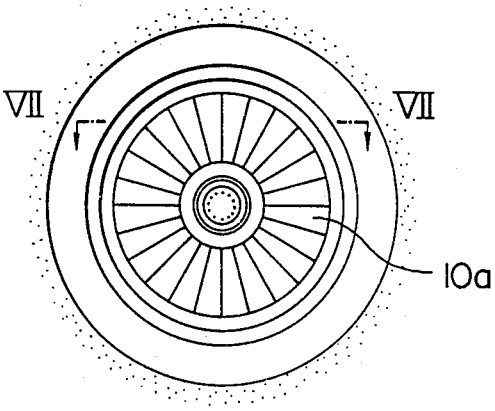
FIG. 6 is a view of the combustion apparatus as viewed in the direction of an arrow A in FIG. 5.
Figure 7:
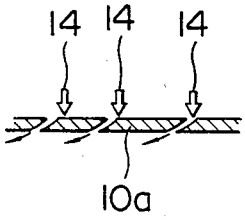
FIG. 7 is a sectional view taken along the line VII—VII of FIG. 6.

Referring to FIG. 5, the conical primary pre-combustion chamber 4 is defined by a flame holder 10. The flame holder 10 therefore has a generally conical shape with its smaller end connected to a seal pipe 11 disposed coaxially with the fuel nozzle 1 and at its larger diameter end to a sleeve pipe 12 which is arranged coaxially with the seal pipe 11. The sleeve pipe 12 is provided with a damper 15 for adjusting the flow rate of seal air supplied from a wind box 13. As will be seen from FIGS. 6 and 7, the flame holder 10 has a plurality of blades 10*a* which extend in the direction of atomization of the fuel. Each blade 10*a* has a trapezoidal form. The side surfaces of the blades 10*a* are inclined by the same amount and the blades 10*a* are disposed such that a predetermined gap is formed between adjacent blades 10*a* as will be seen from FIG. 7 which shows the blades in cross-section. Since the gaps are inclined, the seal air 14 forms a swirl about the axis of the fuel nozzle 1 so as to flow along the inner peripheral surface of the flame holder 10. The direction of this swirl is the same as that of the swirl of the primary air supplied from the primary air nozzle 2. This swirl of the seal air 14 effectively prevents deposition of CWM fuel onto the inner surface of the primary pre-combustion chamber 4. The flow rate of the seal air 14 has to be determined in such a manner as to prevent any tendency against the induction of the atmosphere gas in the secondary pre-combustion chamber 5 back to the primary pre-combustion chamber 4 performed by the primary air.

If there is a risk for the CWM to deposit on to the end of the fuel nozzle 1, it is possible to inject a small amount of air through the gap between the seal pipe 11 and the fuel nozzle 1. Needless to say, this amount of air has to be determined in such a manner as not to impair the induction of the atmosphere gas from the secondary pre-combustion chamber 5.

Figure 8:
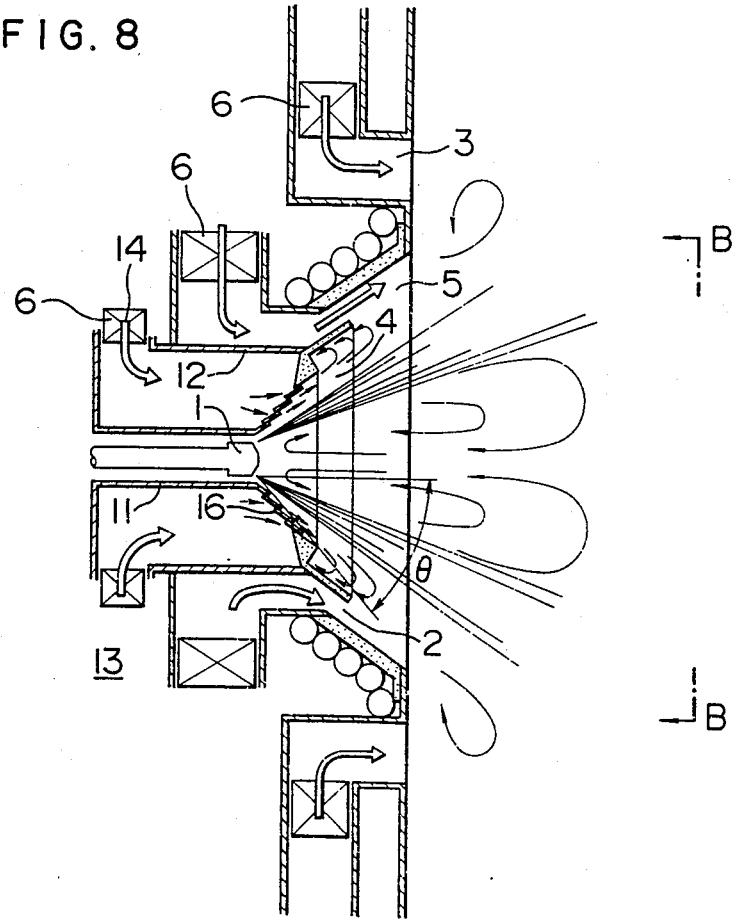
FIG. 8 is a longitudinal sectional view of a modification of the combustion apparatus shown in FIG. 5.
Figure 9:
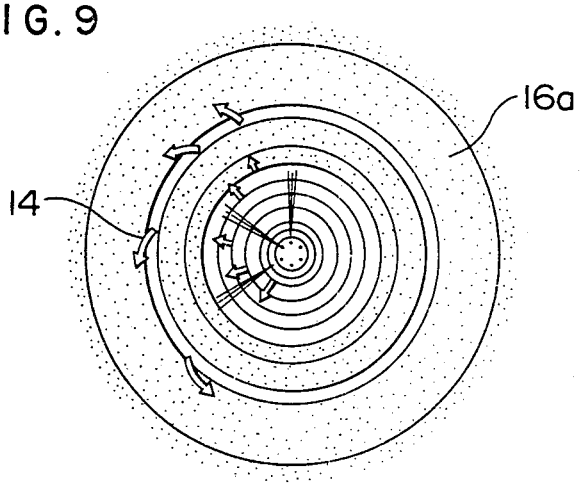
FIG. 9 is a view taken in the direction of an arrow B in FIG. 8.

FIG. 8 shows a modification of the gap formed in the flame holder of the embodiment shown in FIG. 5. In this case also, the conical primary pre-combustion chamber 4 is defined by a flame holder 16. In this case, however, the flame holder 16 is composed of a plurality of conical rings 16*a* having different diameters. These rings 16*a* are arranged such that the larger-diameter end of a smaller ring is disposed within the smaller-diameter end of a larger ring, leaving a predetermined gap left therebetween. The sleeve pipe 12 is provided with the swirl generator 6 so that the seal air 14 supplied from the wind box 13 into the sleeve pipe 12 forms a swirl and this swirl is introduced through the gaps into the primary pre-combustion chamber 4 so as to flow along the inner peripheral wall of the primary pre-combustion chamber 4. This seal air effectively prevents the CWM from attaching to the inner wall surface of the primary pre-combustion chamber 4.

Figure 10:
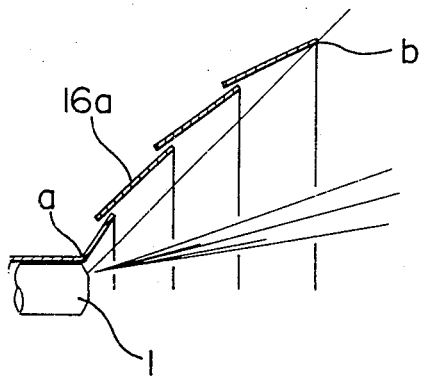
FIGS. 10 and 11 are a sectional view of a primary pre-combustion chamber of the apparatus shown in FIG. 8 and a sectional view of an essential portion of still another embodiment.
Figure 11:
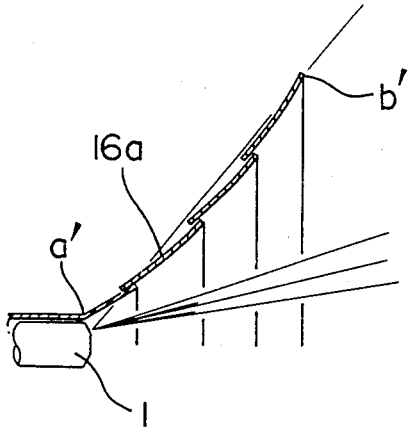

FIGS. 10 and 11 show modifications of the flame holder shown in FIG. 8.

The flame holder shown in FIG. 10 has a flame holding surface which is, when viewed in section taken along the axis of the holder, concaved from a line interconnecting the edge a of the fuel nozzle and the end of the flame holder b. In this case, the seal air effectively impinges upon the inner surface of the flame holder so as to provide a higher sealing effect against deposition of the CWM. Furthermore, when the sectional shape of the flame holder is resembled to a parabolic form, it is possible to concentrate the radiation heat from the flame in the furnace to the CWM jet, thereby vaporization of water in the CWM and improvement of the ignitability of the injected CWM being obtained.

On the other hand, the flame holder shown in FIG. 11 has a flame holding surface which is, when viewed in section, convexed beyond the line interconnecting the edge a′ of the fuel nozzle and the end b′ of the flame holder. In this case, the distance between the jet of CWM and the flame holding surface is progressively increased towards the downstream end, so that the tendency of contact of the CWM with the flame holding surface is suppressed even when the mixture flow of air and CWM is enhanced due to induction of the atmosphere gas from the secondary pre-combustion chamber 5. Thus, the arrangement shown in FIG. 11 also is effective in preventing attaching of the CWM to the surface of the flame holder.

Although the invention has been described with specific reference to the cases where CWMs are used as the fuels. This, however, is not exclusive and the invention is applicable to combustion of various other types of fuel. Since the method and apparatus of the invention makes it possible to efficiently burn coal-water mixtures which are generally difficult to burn, it is clear that the advantage of the invention can be enjoyed also when the invention is applied to combustion of fuels having higher combustibility than CWMs.

What is claimed is:

1. A method of combusting a coal-water mixture comprising:

atomizing said mixture into a conical primary pre-combustion chamber and in a conical jet spray pattern so that the angle of divergence of the conical primary pre-combustion chamber is greater than the atomizing angle of the mixture conical spray pattern to reduce the velocity of said mixture by lateral expansion;

supplying, in the form of a downstream moving swirl about the axis of the jet of the atomizing mixture, primary air from an outer peripheral portion of and downstream of said primary pre-combustion chamber into a secondary pre-combustion chamber connected downstream to said primary pre-combustion chamber, at a rate smaller than that required for the complete burning of said mixture;

forming a region of low pressure around the jet of said mixture and inside of said conical primary pre-combustion chamber due to the angle of divergence being greater than the atomizing angle;

due to said region of low pressure, inducing said primary air from said secondary pre-combustion chamber at a higher temperature than said primary pre-combustion chamber back into said primary pre-combustion chamber into said region of low pressure thereby to promote the evaporation of water content of said mixture, prevent the deposition of particles on the inner wall of said primary pre-combustion chamber and to ignite said mixture;

mixing said mixture with the remainder portion of said primary air in said secondary pre-combustion chamber so as to combust said mixture at a low air-to-ratio, thus forming a region of a reducing atmosphere in said secondary pre-combustion chamber, thereby suppressing generation of NOx; and supplying, in the form of a swirl downstream of said secondary pre-combustion chamber about the axis of the jet of said mixture, secondary air, at a rate large enough to completely burn said mixture, into a furnance connected downstream to said secondary pre-combustion chamber, thereby completely combusting said mixture.

2. The method according to claim 1, further including the preliminary step of providing said mixture with a coal particle size ranging generally between 40 and 100 μm;

wherein said step of atomizing includes providing a jetting velocity of the mixture to promote the atomization and to be 3 to 5 times higher than the velocity of the primary air provided by said step of supplying.

3. An apparatus for combusting a coal-water mixture comprising:

a fuel nozzle means for atomizing said mixture into fine particles and jetting the same into a furnace at a conical pattern having an angle of divergence;

a primary pre-combustion chamber coaxial with said fuel nozzle and conically diverging from the end of said fuel nozzle at an angle greater than said angle of divergence;

a secondary pre-combustion chamber provided downstream from said primary pre-combustion chamber;

an annular primary air nozzle means arranged around the outer periphery of and downstream of said primary precombustion chamber and adapted to supply primary air into said secondary pre-combustion chamber in the form of a downstream swirl about the axis of said nozzle; and a secondary air nozzle means disposed around the outer periphery of and downstream of said secondary pre-combustion chamber for supplying secondary air into said furnace in the form of a downstream swirl about the axis of said nozzle.

4. An apparatus according to claim 3, wherein said primary pre-combustion chamber is made of a heat-accumulating material.

5. An apparatus according to claim 3, wherein said primary air is supplied at a rate smaller than that required for complete burning of said mixture.

6. An apparatus according to claim 3, wherein said secondary air is supplied at a rate sufficient to completely burn said mixture.

7. An apparatus for combusting a coal-water mixture according to claim 2, wherein said primary pre-combustion chamber is defined by a conical flame holder having a plurality of gaps and includes means providing seal air through said gaps in the form of a swirl about the axis of said fuel nozzle so that said seal air flows along the inner peripheral wall of said primary pre-combustion chamber.

8. An apparatus according to claim 7, wherein said primary air is supplied at a rate smaller than that required for complete burning of said mixture.

9. An apparatus according to claim 7, wherein said secondary air is supplied at a rate sufficient to completely burn said mixture.

10. An apparatus according to claim 7, wherein said flame holder comprises a plurality of blades extending in the direction of atomization of said mixture, each blade having a trapezoidal form with tapered side surfaces, said blades being arranged such that predetermined gaps are left between adjacent blades so as to form passages for the seal air to be supplied into said primary pre-combustion chamber.

11. An apparatus according to claim 7, wherein said flame holder comprises a plurality of frusto-conical rings of different diameters, said rings being arranged such that the larger-diameter end of a smaller ring is positioned within the smaller-diameter end of a larger ring, leaving a predetermined annular gap between adjacent rings;

said apparatus further comprising sleeve pipe connected to said flame holder and a swirl generator provided on said sleeve pipe so as to cause said seal air to swirl.

12. An apparatus according to claim 11, wherein said flame holder has a flame holding surface which is, when viewed in section along the axis of said flame holder, concaved from the line interconnecting the edge of said fuel nozzle and the end of said flame holder.

13. An apparatus according to claim 11, wherein said flame holder has a flame holding surface which is, when viewed in section along the axis of said flame holder, convexed beyond the line interconnecting the edge of said fuel nozzle and the end of said flame holder.

* * * * *